US010268150B2

(12) United States Patent
Aiba

(10) Patent No.: US 10,268,150 B2
(45) Date of Patent: Apr. 23, 2019

(54) IMAGE FORMING APPARATUS

(71) Applicant: CANON KABUSHIKI KAISHA, Tokyo (JP)

(72) Inventor: Shozo Aiba, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/642,727

(22) Filed: Jul. 6, 2017

(65) Prior Publication Data

US 2018/0017920 A1 Jan. 18, 2018

(30) Foreign Application Priority Data

Jul. 13, 2016 (JP) ..... 2016-138699

(51) Int. Cl.
*G03G 15/00* (2006.01)

(52) U.S. Cl.
CPC ..... *G03G 15/5054* (2013.01); *G03G 15/5058* (2013.01); *G03G 15/556* (2013.01)

(58) Field of Classification Search
CPC ..... G03G 15/5054; G03G 15/5058; G03G 15/5033; G03G 15/556; G03G 15/0849–15/0855; G03G 2215/00029–2215/00046; G03G 2215/00059
See application file for complete search history.

(56) References Cited

U.S. PATENT DOCUMENTS

2008/0219682 A1* 9/2008 Yamasaki ..... G03G 15/0131 399/16
2017/0108804 A1* 4/2017 Nagata ..... G03G 15/1665

FOREIGN PATENT DOCUMENTS

| | | | |
|---|---|---|---|
| JP | 01-182750 | A | 7/1989 |
| JP | 05-27527 | A | 2/1993 |
| JP | 06-149057 | A | 5/1994 |
| JP | 2011-048118 | A | 3/2011 |

OTHER PUBLICATIONS

Yamamoto et al. "Electrophotographic Color Printer Engine." OKI Technical Review, vol. 64. Aug. 1998. pp. 15-20.*

* cited by examiner

*Primary Examiner* — Carla J Therrien
(74) *Attorney, Agent, or Firm* — Venable LLP

(57) ABSTRACT

An image forming apparatus includes an image bearing member, a developing apparatus, a toner supply portion, a toner density detection portion, an intermediate transfer body, a secondary transfer body, an image density detection unit, and a control unit. The control unit sets a transfer condition of at least either a primary transfer portion or a secondary transfer portion based on an image density being detected by the image density detection unit in a state where a target toner density set based on the image density being detected reaches a limit value of a predetermined setting range.

10 Claims, 8 Drawing Sheets

IMAGE FORMING APPARATUS

BACKGROUND OF THE INVENTION

Field of the Invention

The present invention relates to an image forming apparatus having a transfer body configured to form a transfer portion with an image bearing member to form an image on a recording material by applying an electro-photographic system or an electrostatic recording system.

Description of the Related Art

Hitherto, image forming apparatuses adopting an electrophotographic system are widely used as copying machines, printers, plotters, facsimile machines, and multifunction machines having multiple functions. In this type of image forming apparatuses, an apparatus is widely adopted in which an electrostatic image formed on a photoconductor is developed using a developer, i.e., two-component developer, including toner (nonmagnetic) and carrier (magnetic) as main components. In a developing apparatus using the two-component developer, the density of toner within the developer is controlled such that a constant toner charge is maintained, and such that the electrostatic image formed under predetermined charge and exposure conditions is developed by a predetermined toner loading amount. If toner charge is reduced, the toner loading amount is increased and the image density rises even according to the same electrostatic image, so according to the control for maintaining a fixed toner charge, the toner density is lowered and friction opportunity of developer is increased so as to raise the toner charge. Meanwhile, if the toner charge is increased, the toner loading amount is reduced and the image density is lowered even according to the same electrostatic image, so according to the control for maintaining a fixed toner charge, the toner density is raised and friction opportunity of developer is reduced so as to lower the toner charge.

A control using an inductance sensor provided on a developing apparatus is known as a control for maintaining a fixed toner charge (refer to Japanese Patent Laid-Open No. H01-182750). In the two-component developer, magnetic permeability increases as a ratio of the carrier increases. Therefore, according to this control, the magnetic permeability is detected using an inductance sensor, a signal corresponding to the toner density is output, and a developer corresponding to the signal value is supplied to the developing apparatus to maintain a fixed toner charge.

As another control for maintaining a fixed toner charge, a control using an optical sensor configured to detect a specular reflection light amount of LED light reflected on a patch image formed at an interval between images during continuous image forming is known (refer to Japanese Patent Laid-Open No. H06-149057). The optical sensor is capable of outputting a signal corresponding to a toner loading amount of the patch image. Therefore, according to this control, the toner density of the developer is controlled and the toner charge is controlled to a fixed value by supplying the developer to a developer container such that the toner loading amount of the patch image formed under a predetermined charging and exposing condition is converged to a predetermined value. This control is so-called patch detection ATR (Automatic Toner Replenishing).

As another control for maintaining a fixed toner charge, a control using a video count unit configured to count and add up the total number of developed dots of the whole binarymodulated image supplied to a light source of the exposing unit is known (refer to Japanese Patent Laid-Open No. H05-027527). According to this control, an amount of toner consumed in developing one image is computed by processing image data to be subjected to image forming or exposure signals. Then, an amount of developer corresponding to the amount of toner being consumed is supplied so as to control the toner density of the developer and maintain a fixed toner charge.

As another control for maintaining a fixed toner charge, a control method using three types of controls, which are the above-described inductance control, video count control and patch detection ATR control, to stabilize the output image density in a balanced manner is known (refer to Japanese Patent Laid-Open No. 2011-48118). According to this control, a video count unit is used to compute a toner supply amount corresponding to a predicted toner consumption amount in a feed-forward manner, and an inductance control unit is used to execute feedback-correction control correcting deviation of toner density with respect to a reference value. For example, if inductance control unit is used alone in a case where there is a large amount of toner consumption, there may be a case where the toner density drops unexpectedly due to a detection delay caused by the time difference from the time when toner is supplied to when the supplied toner reaches the inductance control unit. Therefore, it is preferable from the viewpoint of improvement of toner supply accuracy by determining a rough amount of toner supply based on a video count information, and correcting the value based on the inductance information.

According to this control method, a control is executed in which a target value in the inductance control unit is changed arbitrarily according to the target toner density computed by the patch detection ATR. It is well known that even if the same toner density is set, a carrier charging property is deteriorated by attachment of toner to the surface of the carrier, and the toner charge is gradually deteriorated along with durability. Therefore, it is preferable to change the target value of toner density by inductance control through a low-frequency patch detection ATR. As described, by realizing a constant toner charge combining the three types of control, it is possible to stabilize output image density without significantly deteriorating productivity, even in a state where there is a large amount of toner consumption or if the carrier charging property is changed along with durability.

However, according to the respective image forming apparatuses described above, if the control value is maintained at an upper limit or a lower limit of a controllable range, there may be a case where the toner density is maintained at the upper limit value or the lower limit value. In that case, the charged amount of the toner may be changed more than expected, and the image quality may be deteriorated significantly.

For example, it is known that toner charge tends to drop in a high temperature and high humidity environment. In that case, if an image having a high image ratio is output continuously under the same environment, toner supply is performed continuously based on the video count information, friction charge opportunity with the carrier is not sufficiently ensured, and the toner charge drops. If the toner charge drops, patch density on the intermediate transfer belt is increased, such that the ratio of toner and carrier, i.e., TD ratio, is changed by ATR control so that the toner charge will not drop. If output of image having a high image ratio is continued further, the TD ratio reaches a lower limit. In the lower limit of TD ratio, the carrier ratio is increased, such that a phenomenon may occur where the carrier attaches to a white part (non-toner printing portion) of the electrostatic image on the photosensitive drum during development. If carrier is attached to the white part, spot-like uneven transfer may occur at portions where there is carrier and where there is no carrier in the transfer portion, or the attachment and fixing of the carrier on a transfer member may deteriorate the image quality significantly. In order to prevent such phenomenon, there is a need to determine a lower limit value of the target TD ratio.

Meanwhile, it is known that the toner charge tends to increase in a low temperature and low humidity environment. In that case, if an image having a low image ratio is output continuously under the same environment, frictional charge of toner and carrier is promoted, and the toner charge increases. If the toner charge increases, patch density during ATR control is lowered, such that a target value of inductance control is changed to raise the TD ratio. At that time, if the TD ratio is raised excessively, frictional charge between toner and carrier will not be performed sufficiently, and toner adhesion, i.e., fogging, to the white part due to non-charged toner is increased, deteriorating the image quality significantly. In order to prevent such phenomenon, it is necessary to determine the upper limit value of the target TD ratio.

In the above-described image forming apparatus, inductance control is executed such that a target TD value exists between the upper and lower limit values being set. However, if continuous printing of a high-image-ratio image is executed under a high temperature and high humidity environment, the target TD ratio will be maintained at the lower limit value, and it becomes difficult to perform control to suppress deterioration of toner charge. Further, if continuous printing of a low-image-ratio image is executed in a low temperature and low humidity environment, the target TD ratio will be maintained at the upper limit value, and it becomes difficult to perform control to suppress increase of toner charge. If such state occurs in which toner charge is difficult to control, setting of an appropriate transfer condition in the transfer portion becomes difficult, and deterioration of image quality is caused. Thus, there is a demand to optimize the transfer condition even if the target value of the toner density is maintained at the upper limit value or the lower limit value.

SUMMARY OF THE INVENTION

According to one aspect of the present invention, an image forming apparatus includes an image bearing member configured to bear an electrostatic image, a developing apparatus configured to develop the electrostatic image formed on the image bearing member with toner using a two-component developer including toner and carrier, a toner supply portion configured to supply toner to the developing apparatus, a toner density detection portion configured to detect a toner density in an interior of the developing apparatus, an intermediate transfer body configured to contact with the image bearing member and form a primary transfer portion with the image bearing member, a toner image formed on the image bearing member being primarily transferred to the intermediate transfer body in a state where a primary transfer bias is applied to the primary transfer portion, a secondary transfer body configured to contact with the intermediate transfer body and form a secondary transfer portion with the intermediate transfer body, a toner image primarily transferred to the intermediate transfer body being secondarily transferred onto a recording material by the secondary transfer body in a state where a secondary transfer bias is applied to the secondary transfer portion, an image density detection unit configured to detect an image density of a toner image for controlling image density, and a control unit configured to set a target toner density based on the image density being detected by the image density detection unit, and control a supply amount of toner from the toner supply portion to the developing apparatus based on a relationship between the toner density being detected and the target toner density. The control unit sets a transfer condition of at least either the primary transfer portion or the secondary transfer portion based on the image density being detected in a state where the target toner density set based on the image density being detected reaches a limit value of a predetermined setting range.

Further features of the present invention will become apparent from the following description of exemplary embodiments with reference to the attached drawings.

DESCRIPTION OF THE EMBODIMENTS

Now, a preferred embodiment of the present invention will be described in detail with reference to FIGS. 1 through 6B. According to the present embodiment, a tandem type full color printer is described as an example of an image forming apparatus 1. However, the present invention is not restricted to a tandem type image forming apparatus 1, and it can be other types of image forming apparatuses, or can be monochrome or mono color instead of full color. It can be also executed for various purposes, such as printers, various presses, copying machines, facsimile machines, multifunction machines and so on.

Figure 1:
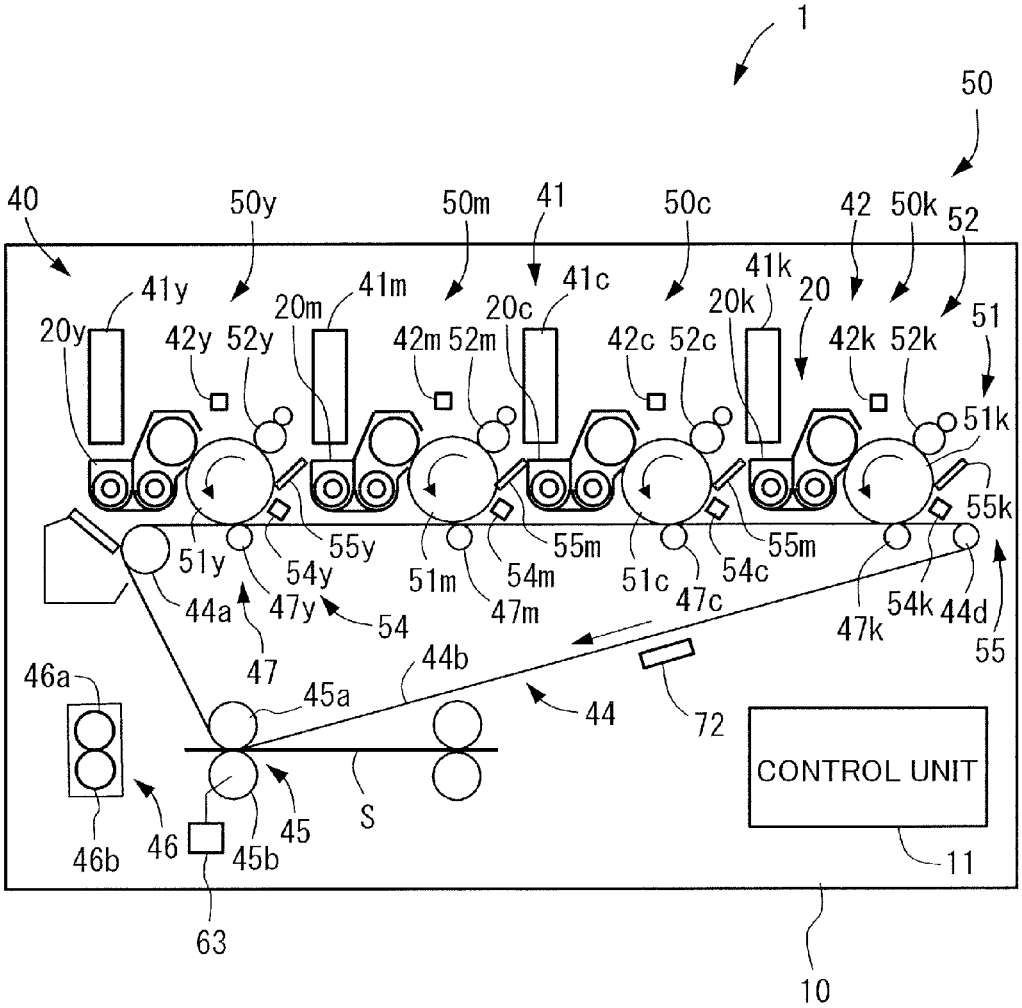
FIG. 1 is a cross-sectional view illustrating a schematic configuration of an image forming apparatus according to the present embodiment.

As illustrated in FIG. 1, the image forming apparatus 1 includes an apparatus body 10, a sheet feeding unit (not shown), an image forming portion 40, a sheet discharge portion (not shown), and a control unit 11. The image forming apparatus 1 can form a four-color full-color image on a recording material according to an image signal from a document reading apparatus (not shown), a host device such as a personal computer, or external equipment such as a digital camera or a smartphone. A toner image is formed on a sheet S serving as a recording material, and specific examples of the sheet S include plain paper, synthetic resin sheet as a substitute of plain paper, cardboard, OHP sheet and so on.

The image forming portion 40 is capable of forming an image on a sheet S fed from the sheet feeding unit based on image information. The image forming portion 40 includes image forming units 50*y*, 50*m*, 50*c* and 50*k*, toner bottles 41*y*, 41*m*, 41*c* and 41*k*, exposing units 42*y*, 42*m*, 42*c* and 42*k*, an intermediate transfer unit 44, a secondary transfer portion 45, and a fixing portion 46. The image forming apparatus 1 according to the present embodiment corresponds to a full color image, and the image forming units 50*y*, 50*m*, 50*c* and 50*k* adopt similar configurations and are provided independently for each color of yellow (y), magenta (m), cyan (c) and black (k). In FIG. 1, identifiers of color are added at the end of the same reference number for the respective configurations of the four colors, but in FIGS. 2 and 3 or in the specification, there are cases where description is provided showing only the reference numbers without adding the color identifier.

The image forming unit 50 includes a photosensitive drum 51, serving as an image bearing member, configured to form a toner image, a charging roller 52, a developing apparatus 20, a pre-exposing unit 54, and a regulation blade 55. The image forming unit 50 is formed as an integrated unit serving as a process cartridge, and is attached in a detachable manner to the apparatus body 10.

The photosensitive drum 51 is rotatable, and bears an electrostatic image used for image forming. In the present embodiment, the photosensitive drum 51 is a negatively charged organic photoconductor (OPC) having an outer diameter of 30 mm, and it is driven to rotate in an arrow direction at a process speed (peripheral speed) of 210 mm/sec, for example. The photosensitive drum 51 has an aluminum cylinder as base, and includes an undercoating layer, an optical charge generating layer and a charge transport layer, which are sequentially coated and laminated on the surface of the base as surface layers.

Figure 2:
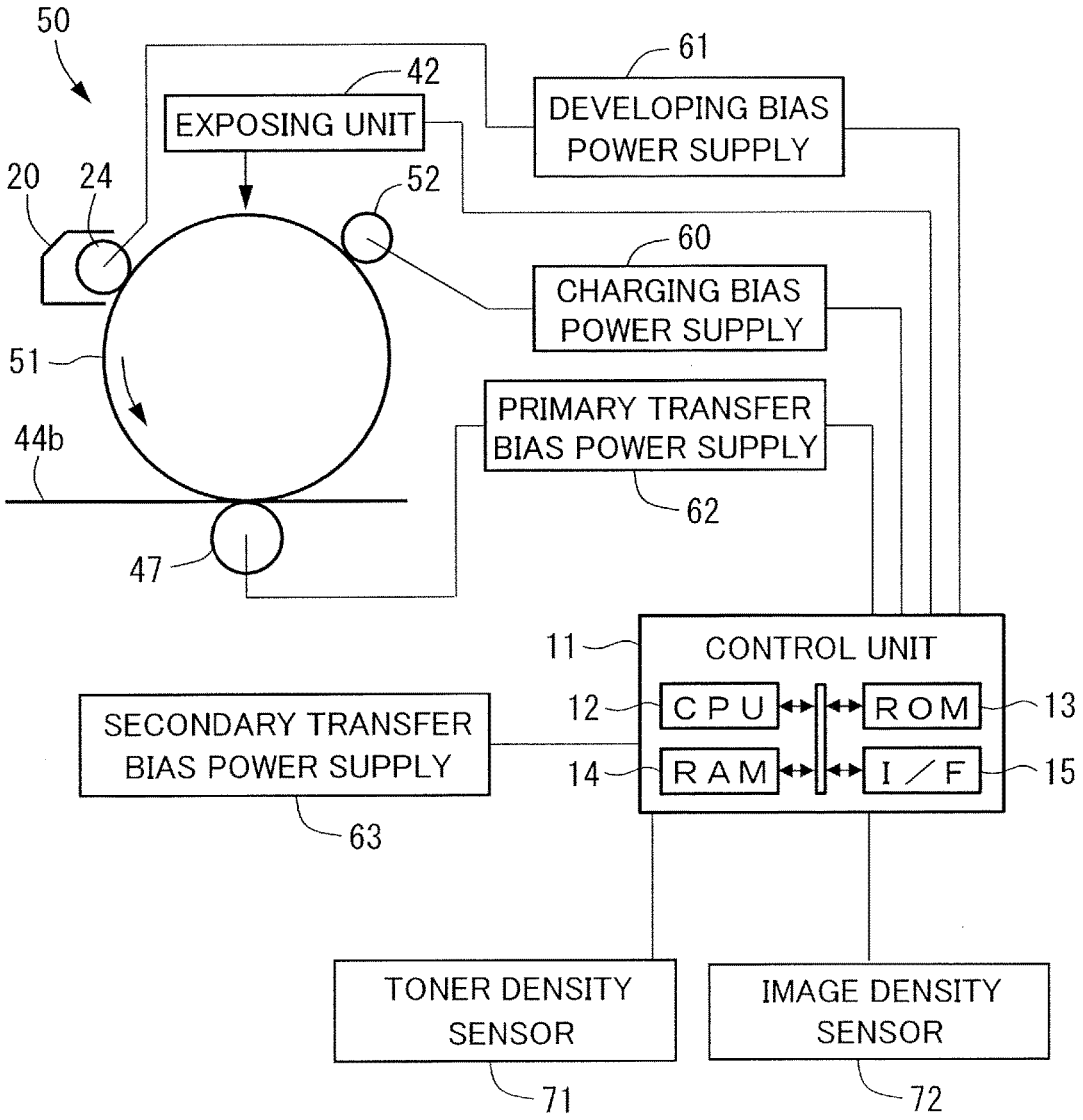
FIG. 2 is a cross-sectional view illustrating a schematic configuration of a photosensitive drum and peripheral mechanisms of the image forming apparatus according to the present embodiment.

As illustrated in FIG. 2, the charging roller 52 uses a rubber roller that contacts a surface of the photosensitive drum 51 and is driven to rotate, charging the surface of the photosensitive drum 51 uniformly. A charging bias power supply 60 is connected to the charging roller 52. The charging bias power supply 60 applies DC voltage as charging bias to the charging roller 52, and charges the photosensitive drum 51 via the charging roller 52.

An exposing unit 42 is a laser scanner, and emits laser beams according to image information of separated colors output from the control unit 11. If developing bias is applied, the developing apparatus 20 develops the electrostatic image formed on the photosensitive drum 51 using toner. A developing bias power supply 61 for applying developing bias is connected to the developing apparatus 20. The details of the developing apparatus 20 will be described later.

The toner image developed on the photosensitive drum 51 is primarily transferred to an intermediate transfer belt 44*b* described later. As illustrated in FIG. 1, the surface of the photosensitive drum 51 after primary transfer is discharged by the pre-exposing unit 54. The regulation blade 55 is a counter blade, which is an elastic blade mainly formed of urethane having a 8-mm free length of the blade, and it is abutted against the photosensitive drum 51 with a predetermined pressing force.

The intermediate transfer unit 44 includes a plurality of rollers such as a drive roller 44*a*, a driven roller 44*d*, and primary transfer rollers 47*y*, 47*m*, 47*c* and 47*k*, and an intermediate transfer belt 44*b* wound around the rollers and bearing a toner image. The primary transfer rollers 47*y*, 47*m*, 47*c* and 47*k* are respectively arranged to face the photosensitive drums 51*y*, 51*m*, 51*c* and 51*k*, and are contacted with the intermediate transfer belt 44*b*. A primary transfer bias power supply 62 for applying primary transfer bias is connected to a primary transfer roller 47 (refer to FIG. 2).

The intermediate transfer belt 44*b*, serving as an intermediate transfer body, is an endless belt stretched rotatably around a plurality of rollers. The intermediate transfer belt 44*b* contacts with the photosensitive drum 51 and forms a primary transfer portion with the photosensitive drum 51, and in a state where a primary transfer bias is applied to the primary transfer portion, the toner image formed on the photosensitive drum 51 is primarily transferred at the primary transfer portion. In a state where a primary transfer bias having positive polarity is applied by the primary transfer roller 47 to the intermediate transfer belt 44*b*, the toner images having negative polarity formed on the respective photosensitive drums 51 are sequentially transferred in multiple layers onto the intermediate transfer belt 44*b*.

An image density sensor 72, serving as an image density detection unit, configured to detect an image density of a patch image for image density control, that is, a toner image for image density control, is arranged to face the intermediate transfer belt 44*b*.

The secondary transfer portion 45 includes a secondary transfer inner roller 45*a* and a secondary transfer outer roller 45*b*, serving as a secondary transfer body. A secondary transfer bias power supply 63 configured to apply a secondary transfer bias is connected to the secondary transfer outer roller 45*b*. In a state where the secondary transfer bias having positive polarity is applied to the secondary transfer outer roller 45*b*, a full color toner image formed on the intermediate transfer belt 44*b* is transferred onto a sheet S. The secondary transfer outer roller 45*b* contacts with the intermediate transfer belt 44*b* and forms the secondary transfer portion 45 with the intermediate transfer belt 44*b*, and in a state where the secondary transfer bias is applied to the secondary transfer portion 45, the toner image primarily transferred to the intermediate transfer belt 44*b* is secondarily transferred to the sheet S at the secondary transfer portion 45.

The fixing portion 46 includes a fixing roller 46*a* and a pressure roller 46*b*. A sheet S is nipped and conveyed between the fixing roller 46*a* and the pressure roller 46*b*, by which the toner image transferred to the sheet S is heated, pressed, and fixed to the sheet S. A sheet discharge portion feeds the sheet S conveyed through a discharge path after having the image fixed, and discharges the sheet through a discharge opening onto a sheet discharge tray.

Figure 3:
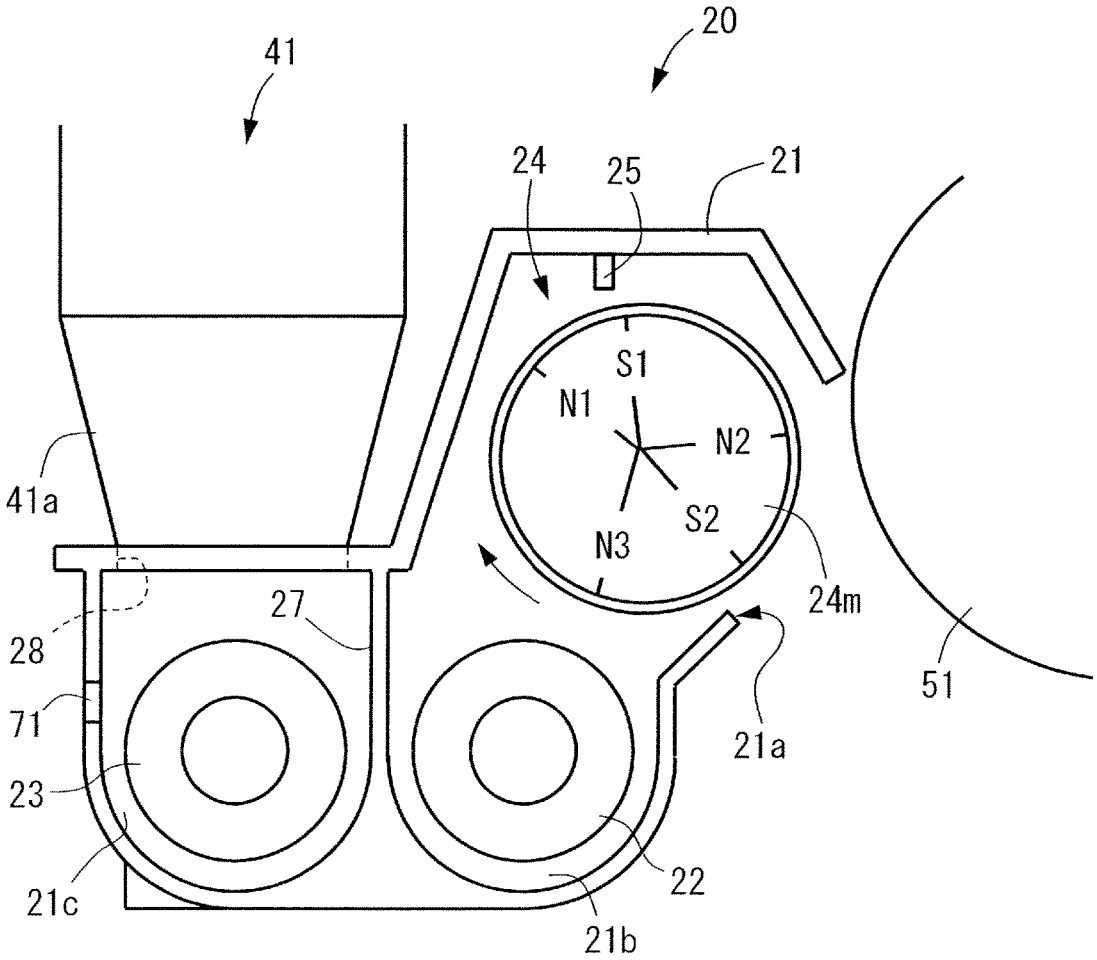
FIG. 3 is a cross-sectional view illustrating a schematic configuration of a developing apparatus of the image forming apparatus according to the present embodiment.
Figure 4:
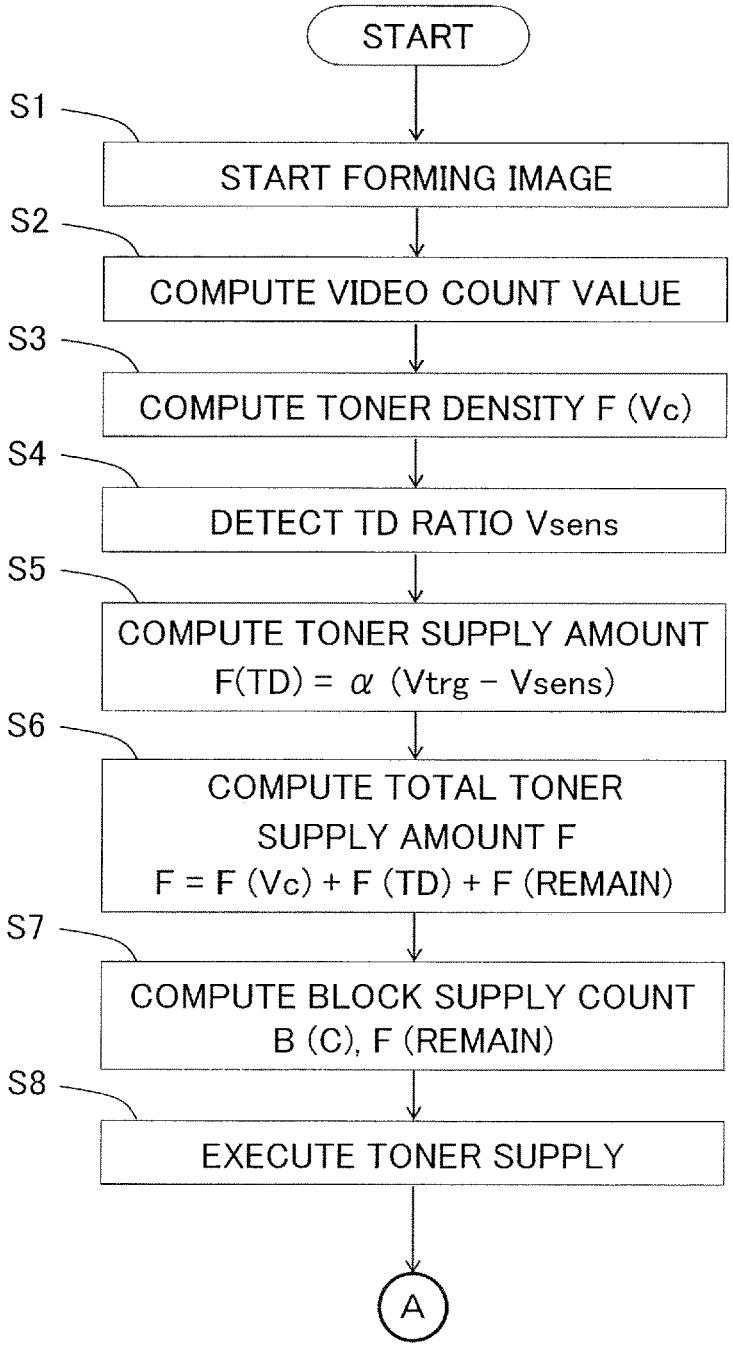
FIG. 4 is a flowchart illustrating a procedure for computing a toner supply amount based on a video count value and a toner density and supplying toner in the image forming apparatus according to the present embodiment.
Figure 5:
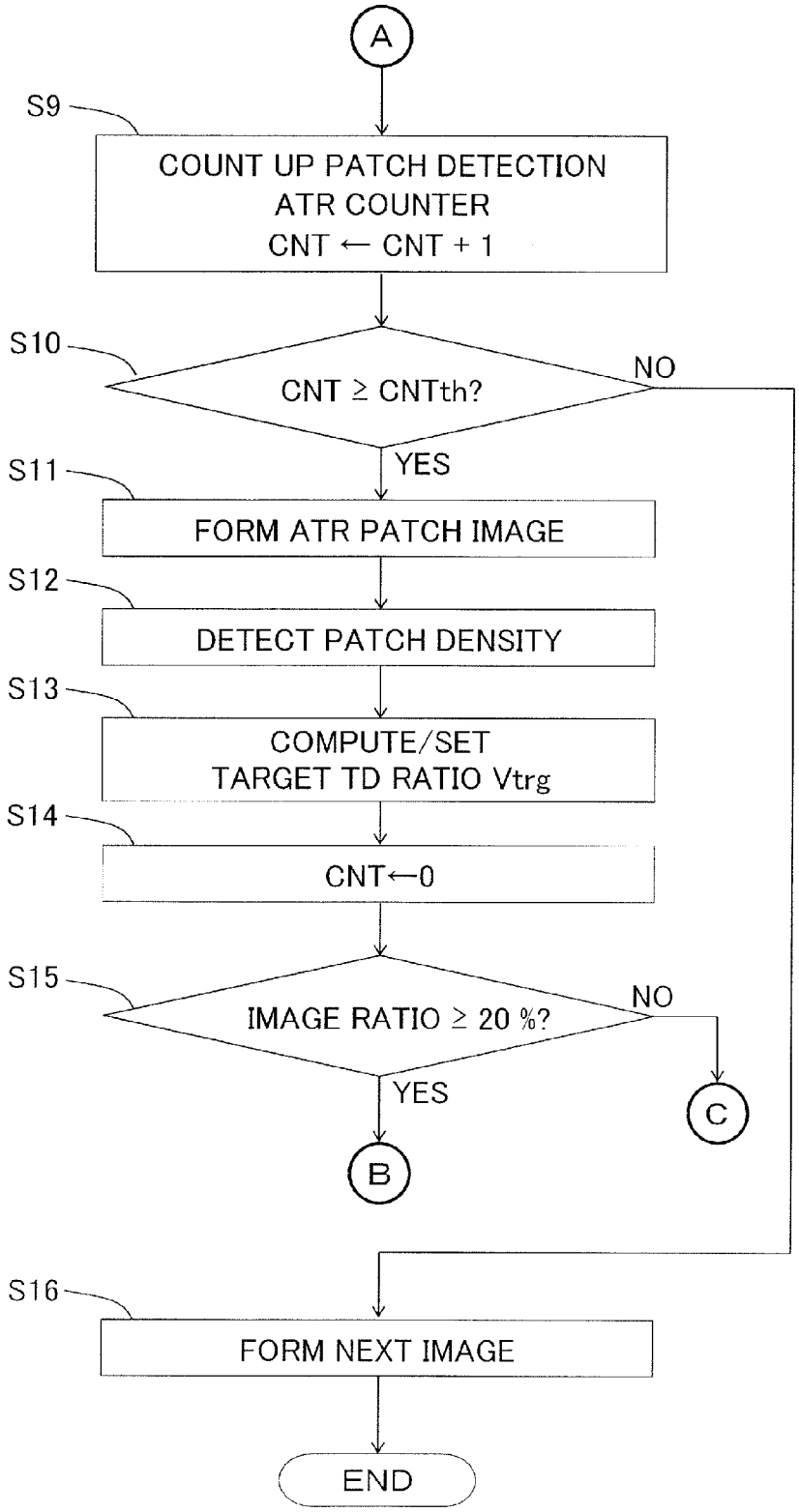
FIG. 5 is a flowchart illustrating a procedure for executing a patch detection ATR in the image forming apparatus according to the present embodiment.
Figure 6A:
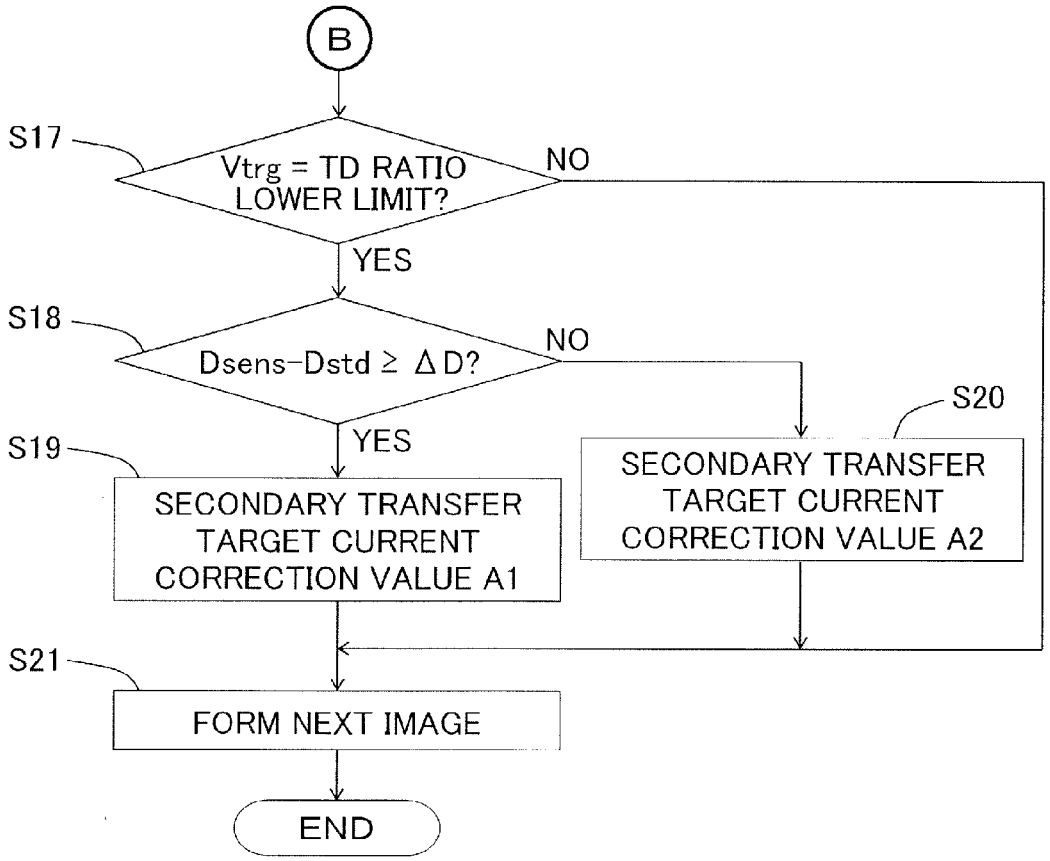
FIG. 6A is a flowchart illustrating a procedure for computing a correction value of a secondary transfer current after executing patch detection ATR in a case of high image ratio in the image forming apparatus according to the present embodiment.
Figure 6B:
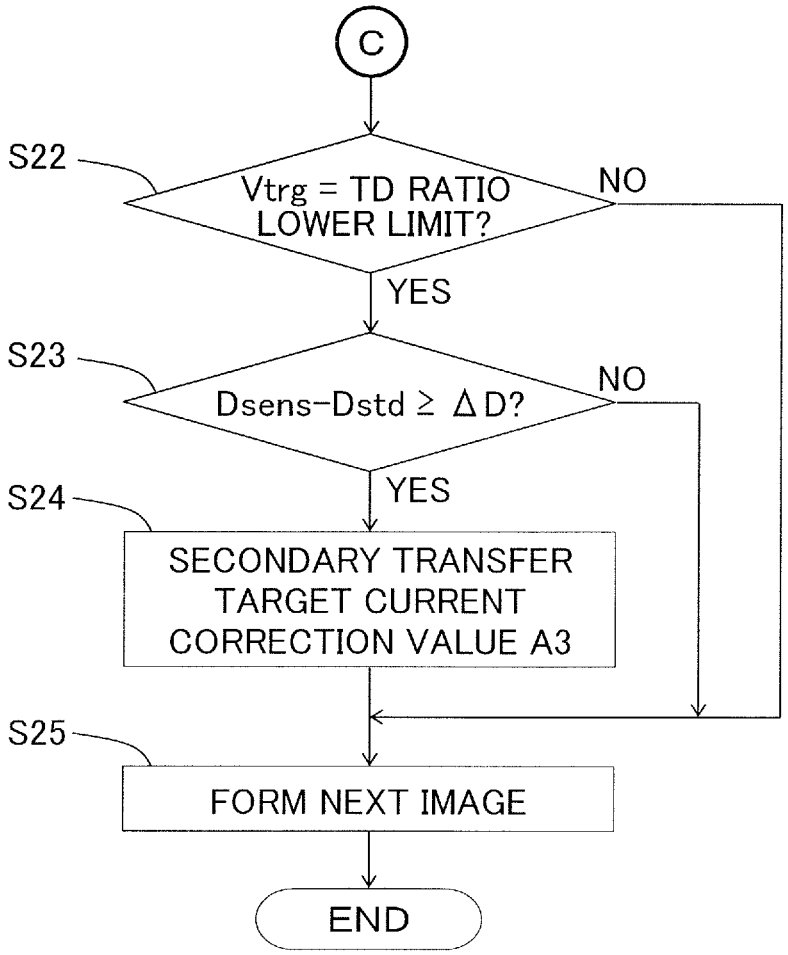
FIG. 6B is a flowchart illustrating a procedure for computing a correction value of a secondary transfer current after executing patch detection ATR in a case of low image ratio in the image forming apparatus according to the present embodiment.

As illustrated in FIG. 3, the developing apparatus 20 includes a developer container 21 configured to store a developer, a first conveyance screw 22, a second conveyance screw 23, a developing sleeve 24, a regulation member 25, and a toner density sensor 71. The developing apparatus 20 stores a developer, and develops the electrostatic image formed on the photosensitive drum 51 using the two-component developer containing toner and carrier. The developer container 21 has an opening portion 21*a* through which the developing sleeve 24 is exposed at a position facing the photosensitive drum 51.

The developer container 21 has a partition wall 27 extending in a longitudinal direction at roughly a center portion thereof. The developer container 21 is divided in a horizontal direction by the partition wall 27 into a developing chamber 21*b* and an agitating chamber 21*c*. The developer is stored in the developing chamber 21*b* and the agitating chamber 21*c*. The developing chamber 21*b* supplies the developer to the developing sleeve 24. The agitating chamber 21*c* is communicated with the developing chamber 21*b*, and collects the developer from the developing sleeve 24 and agitates the developer. Two connecting portions (not shown) mutually communicating the developing chamber 21*b* and the agitating chamber 21*c* at both ends portions are formed on the partition wall 27 between the developing chamber 21*b* and the agitating chamber 21*c*.

The first conveyance screw 22 is arranged approximately in parallel with the developing sleeve 24 within the developing chamber 21*b*, and conveys while agitating the developer inside the developing chamber 21*b*. The second conveyance screw 23 is arranged approximately in parallel with the first conveyance screw 22 within the agitating chamber 21*c*, and conveys the developer within the agitating chamber 21*c* to an opposite direction as the first conveyance screw 22. That is, the developing chamber 21*b* and the agitating chamber 21*c* constitute a circulation path of the developer configured to convey while agitating the developer. Toner is agitated by the respective screws 22 and 23, and frictionally charged to negative polarity by being rubbed against the carrier. A return screw (not shown) with an opposite conveyance direction is provided on a downstream end portion in a conveyance direction of the second conveyance screw 23. In the agitating chamber 21*c*, a large portion of the developer conveyed from the upstream side is pushed back by the return screw and conveyed from the connecting portion to the developing chamber 21*b*. The developing sleeve 24 and the conveyance screws 22 and 23 are connected via a gear mechanism (not shown) at an outer side of the developer container 21, and driven to rotate integrally by a common drive motor.

In the agitating chamber 21*c*, on an upstream end in the conveyance direction of the developer, is formed a feed port 28 opening upward, and a hopper 41*a* of a toner bottle 41, serving as a toner supply portion, is connected to the feed port 28. The toner bottle 41 is configured to supply toner to the developing apparatus 20, and the toner supplied from the toner bottle 41 is supplied via the hopper 41*a* through the feed port 28 into the agitating chamber 21*c*. A screw is provided at a lower portion of the toner bottle 41, and the toner stored in the toner bottle 41 is supplied to the agitating chamber 21*c* by the rotation of the screw. The screw is driven by the motor controlled by the control unit 11 serving as the drive source.

The developing sleeve 24 bears the developer containing nonmagnetic toner and magnetic carrier, and conveys the developer to a developing area facing the photosensitive drum 51. The developing sleeve 24 is formed of a nonmagnetic material such as aluminum or nonmagnetic stainless steel, and in the present embodiment, it is formed of aluminum. A roller-shaped magnet roller 24*m*, serving as a magnetic field generating portion, is arranged in a fixed state at an inner side of the developing sleeve 24 in a non-rotatable manner with respect to the developer container 21. A magnet roller 24*m* has a plurality of magnetic poles N1, S1, N2, S2 and N3 formed on the surface.

A toner density sensor 71, serving as a toner density detection portion, is provided, for example, on a side wall of the agitating chamber 21*c*, and detects toner density by detecting the developer inside the developer container 21 and outputting a signal corresponding to the ratio of toner in the developer. A developer having toner and carrier as main components is stored in the developer container 21, and a ratio, that is, toner density or TD ratio, indicating the percentage of weight of the toner in the developer in the initial state, is approximately 8%. The TD ratio should be adjusted appropriately according to toner charge, carrier particle diameter, structure of the developing apparatus 20 and so on, and it should not be restricted to 8%.

The developing bias power supply 61 (refer to FIG. 2) applies oscillation voltage in which AC voltage is superposed to a DC voltage Vdc having negative polarity to the developing sleeve 24. The developing sleeve 24 having DC voltage Vdc of negative polarity applied thereto has a relatively negative polarity with respect to the electrostatic image formed on the photosensitive drum 51, and the toner charged to negative polarity within the developer is transferred from the developing sleeve 24 to the photosensitive drum 51. The remaining developer after developing the electrostatic image on the developing sleeve 24 is recovered in the developing container 21 by the rotation of the developing sleeve 24, and mixed with the developer conveyed by the conveyance screw 22.

As illustrated in FIG. 2, the control unit 11 is composed of a computer, and includes, for example, a CPU 12, a ROM 13 storing programs configured to control respective units, a RAM 14 configured to store data temporarily, and an input and output circuit (I/F) 15 configured to input and output signals from/to an exterior. The CPU 12 is a microprocessor managing the overall control of the image forming apparatus 1, and it is the subject of a system controller. The CPU 12 is connected via an input and output circuit 15 to the sheet feeding unit, the image forming portion 40 and the sheet discharge portion, and communicates signals with the respective units and controls operation. An image forming control sequence and the like for forming an image on a sheet S is stored in the ROM 13.

Further, the charging bias power supply 60, the developing bias power supply 61, the primary transfer bias power supply 62, the secondary transfer bias power supply 63, the toner density sensor 71 and the image density sensor 72 are connected to the control unit 11. The control unit 11 sets the target toner density based on the detected image density, and controls the toner supply amount from the toner bottle 41 to the developing apparatus based on a relationship between the detected toner density and the target toner density. Further, the control unit 11 sets a transfer condition of at least either the primary transfer portion or the secondary transfer portion 45 based on the detected image density. In a state where the target toner density set by the detected image density reaches a limit value of the predetermined setting range, the control unit 11 sets the transfer condition based on the detected image density. The transfer condition here is, for example, the transfer current.

In a state where the target toner density set by the detected image density reaches a lower limit value of the setting range, if a difference between the detected image density and the predetermined reference density is equal to or greater than a predetermined value, the control unit 11 lowers the transfer current. Further, in a state where the target toner density set by the detected image density reaches the lower limit value of the setting range, if the difference between the detected image density and the predetermined reference density is equal to or greater than a predetermined value, the control unit 11 sets the correction value of the transfer current to a first correction value. In a state where the target toner density set by the detected image density reaches the lower limit value of the setting range, if the difference between the detected image density and the predetermined reference density is smaller than a predetermined value, the control unit 11 sets the correction value of the transfer current to a second correction value smaller than the first correction value.

Next, an image forming operation according to the image forming apparatus 1 having the above-described configuration will be described.

In a state where the image forming operation is started, at first, the photosensitive drum 51 is rotated and the surface is charged by the charging roller 52. Then, laser beams are emitted to the photosensitive drum 51 based on image information by the exposing unit 42, and an electrostatic latent image is formed on the surface of the photosensitive drum 51. If toner is attached to the electrostatic latent image, the image is developed and visualized as toner image, and transferred to the intermediate transfer belt 44*b*.

Meanwhile, simultaneously as such toner image forming operation, sheet S is supplied, and the sheet S is conveyed via a conveyance path to the secondary transfer portion 45 at a matched timing with the toner image on the intermediate transfer belt 44*b*. Further, the image is transferred from the intermediate transfer belt 44*b* to the sheet S, and the sheet S is conveyed to the fixing portion 46, where unfixed toner image is heated, pressed and fixed to the surface of the sheet S, and then the sheet is discharged from the apparatus body 10.

Next, a control for supplying toner to the developing apparatus 20 in the image forming apparatus 1 of the present embodiment will be described. A two component developing system has merits such as stable image quality and apparatus durability compared to other developing systems. Meanwhile, if toner is consumed, the TD ratio of the developer within the developer container 21 is varied, and as a result, the toner charge is varied, such that the developing characteristic may vary and the output image density may vary. Therefore, in order to maintain a fixed image density of the formed image, a toner supply control technique is put into practical use in which the TD ratio of the developer or the image density are detected accurately, and adequate amount of toner is provided.

In the present embodiment, a triple control system is adopted in which inductance control, video count control and patch detection ATR control are performed to stabilize the output image density with a good balance. That is, a control is adopted where toner consumption amount is predicted to execute feeding of toner corresponding to the consumed amount by feedforward control, and dispersion of the supply amount is subjected to inductance control such that deviation from the reference value of toner density is corrected by feedback control. However, if only inductance control is performed, for example, in a case where there is a large amount of toner consumption, the toner density may be deteriorated above prediction due to detection delay caused by the difference in time from when toner is supplied to the arrival of toner supplied through inductance control. Therefore, it is preferable from the viewpoint of improvement of toner supply accuracy to determine the outline of the toner consumption amount by video count information, and correcting the amount based on inductance information.

Further, a control for arbitrarily changing the target toner density of the inductance control unit corresponding to the patch image density obtained through patch detection ATR control is executed. That is, it is well known that even if the toner density is the same, the adhesion of toner on the carrier surface deteriorates the carrier charging property, by which the toner charge is gradually deteriorated along with durability. Therefore, it is preferable to change the toner density target value by inductance control through low-frequency patch detection ATR.

According to the present embodiment, if an image having an image ratio lower than 20%, especially having an image ratio of 2 to 10%, is continuously printed on 1000 sheets, for example, ATR patch control is executed every 100 sheets of printing. The image density sensor 72 detects the ATR patch density (toner density of 1.0) transferred to the intermediate transfer belt 44*b*, determines whether the patch density is greater or smaller than the reference density, or whether the patch density is within a predetermined range, and updates a target TD ratio Vtrgt of the inductance control. In the present embodiment, the target TD ratio Vtrgt is set to a value corresponding to the target toner density. Until the next ATR patch control is executed, the toner supply amount and the frequency are adjusted so that the value is converged to the updated target toner density. Then, according to the next ATR patch control, similar to the previous operation, an operation is repeatedly performed in which the toner image density on the intermediate transfer belt 44*b* is detected, and the target value of the inductance is corrected based on the detection result. Thereby, the toner charge can be converged to a certain range.

Further according to the present embodiment, if continuous printing is performed in a state where the image ratio is 20% or greater, the toner charge within the developer container 21 is reduced. Since the reduction of toner charge is significant, the inductance target value Vinduc determined by inductance control is set to a high value, that is, the TD ratio is lowered, each time ATR control is executed. For example, according to the present embodiment, while executing ATR patch control during printing of 1000 sheets, the inductance target value Vinduc is maintained at an upper limit value Vhi of the control value range. If a high-printing-range image is printed further continuously in the state where the inductance target value Vinduc is maintained, deviation from a reference value Dstd of the ATR patch density Dsens is expanded further.

Therefore, an optimum secondary transfer current is changed according to the deviation from the reference value of the ATR patch density. The toner charge at this time was 30 μC/g, and the optimum secondary transfer current was 45 μA. An optimum secondary transfer current refers to a setting in which a solid image of two colors is uniformly transferred onto a sheet, and an HT image or a solid image of a different color is uniformly transferred. For example, if the secondary transfer current is set to an excessive current, the solid image of two colors will be transferred uniformly, but uneven transfer is caused in the single-color solid image or micro white spots are seen on the HT image. Meanwhile, if secondary transfer current is insufficient, the solid image of two colors will not be transferred sufficiently, and the density will not be ensured.

Now, if the reference value of the patch density is represented by Dstd, and the patch density detected during ATR patch control is represented by Dsens, a target value of secondary transfer current Itrgt is corrected as follows. That is, if (Dstd)>(Dsens) and (Dstd)−(Dsens)>ΔD, the target value of the secondary transfer current is set to Itrgt (1+α).

Further, if (Dstd)<(Dsens) and (Dsens)−(Dstd)>ΔD, the target value is set to Itrgt (1−α). The values of ΔD and α are adjustment values provided in advance.

Then, after correcting the target value of the secondary transfer current, ATVC is performed, and a voltage value capable of acquiring the corrected current value is computed. Valueα is an adjustment value, and it is obtained based on values in an environment table determined in advance. The deviation of the ATR patch density from the reference density corresponds to the change in toner charge, and the increase of deviation quantity means increase of change of toner charge. Therefore, it is possible to set the threshold value of the deviation not only to a single step greater or smaller than ΔD, but it is possible to set a plurality of threshold values such as ΔD×2 or ΔD×3, and set the correction coefficient to A1, A2, and A3, corresponding to the respective threshold values. According to this method, improvement of accuracy of transfer setting enabling to set the secondary transfer current corresponding to a greater change of toner charge can be realized. According to the present embodiment, the greatness or smallness of the transfer current or the correction value refers to the greatness or smallness of the absolute value.

Next, the procedure for correcting the secondary transfer current according to the toner density or the patch image density in the image forming apparatus 1 of the present embodiment will be described with reference to FIGS. 4, 5, 6A and 6B. If image forming is started (step S1), the control unit 11 computes a video count value based on image information (step S2). The control unit 11 computes toner density F (Vc) based on the computed video count value (step S3).

Then, the control unit 11 detects TD ratio Vsens based on the toner density sensor 71 (step S4). The control unit 11 computes a toner supply amount F (TD) based on the difference between the detected TD ratio Vsens and the target TD ratio Vtrg (step S5). Further, the control unit 11 computes a total toner supply amount F=F (Vc)+F (TD)+F (REMAIN) (step S6), and computes a block supply number B (C) and F (REMAIN) (step S7). The control unit 11 arbitrarily operates the toner bottle 41 according to the obtained total toner supply amount F, and supplies the toner to the developing apparatus 20 (step S8).

Thereafter, the control unit 11 counts up a patch detection ATR counter CNT (step S9). The control unit 11 determines whether the patch detection ATR counter CNT is equal to or greater than a threshold (such as 100) CNTth (step S10). If the control unit 11 determines that the patch detection ATR counter CNT is smaller than the threshold CNTth, the control unit 11 determines that it is not a timing for executing patch detection, and executes the next image forming (step S16).

If the control unit 11 determines that the patch detection ATR counter CNT is equal to or greater than the threshold CNTth, it forms an ATR patch image between sheets (step S11). Then, the control unit 11 detects the patch density by the image density sensor 72 (step S12), computes and sets a target TD ratio Vtrg based on the detection result (step S13), and resets the patch detection ATR counter CNT to 0 (step S14). Further, the control unit 11 determines whether the image ratio of the predetermined number of sheets is 20% or greater (step S15). The image ratio of the predetermined number of sheets can be, for example, any arbitrary value, such as mean image ratio of the most recent 100 sheets as the predetermined number of sheets, or an accumulated value of image ratio of the most recent 100 sheets. That is, the control unit 11 determines whether the accumulated value of image ratio is equal to or greater than a predetermined value.

If the control unit 11 determines that the image ratio is 20% or greater, it determines that forming of images having a high image ratio have been continuously performed. Then, the control unit 11 determines whether the target TD ratio Vtrg reaches the lower limit of the TD ratio (step S17). If the control unit 11 determines that the target TD ratio Vtrg reaches the lower limit of the TD ratio, the control unit determines whether Dsens−Dstd is equal to or greater than ΔD (step S18). If the control unit 11 determines that Dsens−Dstd is equal to or greater than ΔD, correction is performed to lower a secondary transfer target current by a correction value A1, i.e., first correction value (step S19). Then, if the control unit 11 determines that Dsens−Dstd is smaller than ΔD, correction is performed to lower the secondary transfer target current by a correction value A2, i.e., second correction value, having a smaller lowering width than the correction value A1 (step S20). If it is determined in step S17 that the target TD ratio Vtrg does not reach the lower limit of the TD ratio, or if the secondary transfer target current has been corrected (steps S19 and 20), the control unit 11 executes the next image forming step (step S21).

Further, if the control unit 11 determines in step S15 that the image ratio is smaller than 20%, it determines that forming of images having a high image ratio is not continuously performed. Then, the control unit 11 determines whether the target TD ratio Vtrg reaches a lower limit of the TD ratio (step S22). If the control unit 11 determines that the target TD ratio Vtrg reaches the lower limit of the TD ratio, the control unit 11 determines whether Dsens−Dstd is equal to or greater than ΔD (step S23). If the control unit 11 determines that Dsens−Dstd is equal to or greater than ΔD, it performs a correction to lower the secondary transfer target current by a correction value A3, i.e., third correction value, having a smaller lowering width than the correction value A2 (step S24). Further, if the control unit 11 determines that Dsens−Dstd is smaller than ΔD, or if the control unit 11 determines in step S22 that the target TD ratio Vtrg does not reach the lower limit of the TD ratio, it performs the next image forming step (step S25).

As described, in a state where a mean image ratio of the most recent 100 sheets S to which image has been formed is a predetermined image ratio, for example equal to or greater than 20% (step S15; Yes), if a target toner density Vtrg reaches a lower limit value of the setting range (step S17; Yes), and if Dsens−Dstd is equal to or greater than ΔD (step S18; Yes), the control unit 11 sets the correction value of the secondary transfer current to correction value A1 (step S19). Further, in a state where the mean image ratio of the most recent 100 sheets S to which image has been formed is equal to or greater than image ratio 20% (step S15; Yes), if the target toner density Vtrg reaches a lower limit value of the setting range (step S17; Yes), and if Dsens−Dstd is smaller than ΔD (step S18; No), the control unit 11 sets the correction value of the secondary transfer current to correction value A2 (step S20). Meanwhile, in a state where the mean image ratio of the most recent 100 sheets S to which image has been formed is less than image ratio 20% (step S15; No), if the target toner density Vtrg reaches a lower limit value of the setting range (step S22; Yes), and if Dsens−Dstd is equal to or greater than ΔD (step S23; Yes), the control unit 11 sets the correction value of the secondary transfer current to correction value A3 (step S24). Further, in a state where the mean image ratio of the most recent 100 sheets S to which image has been formed is less than image ratio 20% (step S15; No), if the target toner density Vtrg reaches a lower limit value of the setting range (step S22; Yes), and if Dsens−Dstd is smaller than ΔD (step S23; No), the control unit 11 does not correct the secondary transfer current.

It is effective to perform a similar control also in a case where the toner charge has increased, contrary to the above-described cases where toner charge has been lowered. That is, in a state where the TD ratio is maintained at the upper limit value, the toner density during ATR patch control is lower than the reference toner density, and there is a large deviation, it means that the toner charge is in a high state. If continuous printing is performed under a low temperature and low humidity environment or continuous printing of images having a low image ratio is performed, frictional charging of toner and carrier is performed effectively in the developing apparatus 20, such that the toner charge is increased, and the above-described state tends to occur. If the TD ratio is maintained at the upper limit value, and the ATR patch density is lower than the reference value, the toner charge is raised, and the optimum secondary transfer current is increased. In such case, it is preferable to perform control to increase the secondary transfer current by an operation opposite from that described above. In a state where the target toner density set according to the detected image density reaches the upper limit value of the setting range, if the difference between the detected image density and the predetermined reference density is equal to or greater than a predetermined value, the control unit 11 raises the transfer current.

As described, according to the image forming apparatus 1 of the present embodiment, the control unit 11 controls the supply amount of toner from the toner bottle 41 to the developing apparatus 20 based on the relationship between the detected TD ratio and the target TD ratio. At the same time, the control unit 11 sets the target TD ratio based on the detected image density. Further, the control unit 11 sets the correction value of the secondary transfer current based on the detected image density. Therefore, even if the target toner density is maintained at the upper limit value or the lower limit value, optimization of transfer condition can be realized according to the image density.

According to the image forming apparatus 1 of the first embodiment described above, the correction value of the secondary transfer current is set based on the detected image density, but the present invention is not restricted thereto. For example, a similar control can be performed for the primary transfer current. In that case, the toner image transferred onto the intermediate transfer belt 44*b* is subjected to retransfer at the primary transfer portion of a downstream station, but the amount of retransfer is increased when the toner charge is reduced. If the toner charge is reduced, a phenomenon becomes more significant in which polarity inversion occurs by the discharge received during passing of the primary transfer portion of the downstream station and toner is attached to the photosensitive drum 51 of the downstream station. Therefore, according to the present embodiment, it becomes possible to not only suppress color variation but also suppress increase of the amount of consumption of toner, by determining the lowering of toner charge, reducing the current of the primary transfer portion of the downstream station, and reducing the amount of retransferred toner. In other words, the control unit 11 sets the transfer condition of the transfer portion, or at least either the primary transfer portion or the secondary transfer portion 45, based on the detected image density.

Further according to the present embodiment, the image forming apparatus 1 includes the intermediate transfer belt 44*b*, and a system is adopted in which toner images of respective colors are primarily transferred from the photosensitive drums 51 to the intermediate transfer belt 44*b*, and then the composite toner image of the respective colors is collectively secondarily transferred to the sheet S. However, the present embodiment is not restricted thereto, and a system can be adopted where an image is directly transferred from the photosensitive drum to the sheet conveyed on the sheet conveyance belt. In that case, the control unit 11 sets the correction value of the transfer current based on the detected image density. Therefore, even if the target toner density is maintained at the upper limit value or the lower limit value, the transfer condition can be optimized according to the image density.

Figure 7:
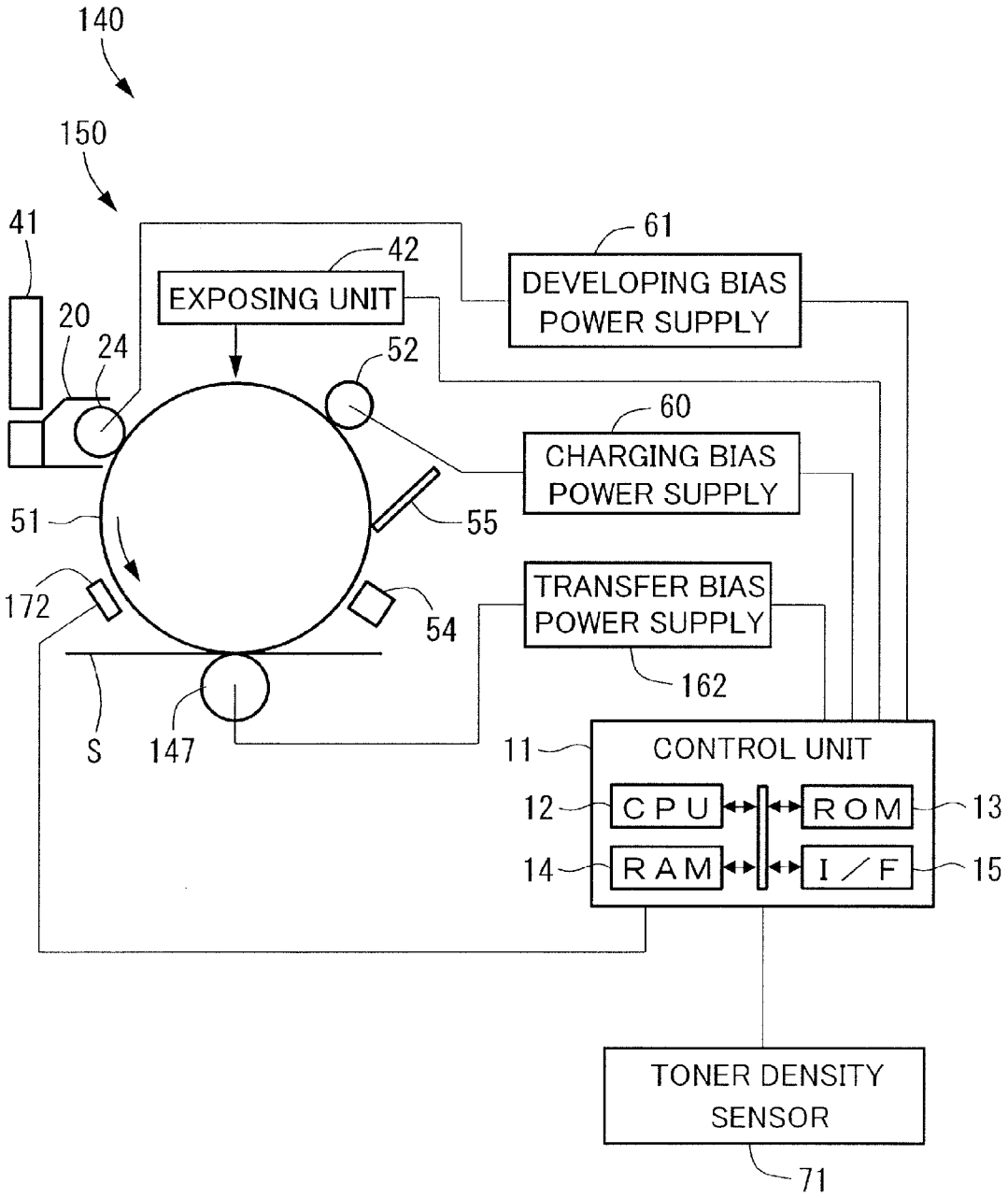
FIG. 7 is a cross-sectional view illustrating a general outline of a photosensitive drum and peripheral mechanisms according to a modified example of the image forming apparatus according to the present embodiment.

For example, as illustrated in FIG. 7, an intermediate transfer unit 44 is not provided in an image forming portion 140. The image forming portion 140 includes an image forming unit 150, a toner bottle, serving as a toner supply portion, 41, an exposing unit 42, and a fixing portion not shown). The image forming unit 150 includes a photosensitive drum 51, serving as an image bearing member, configured to form a toner image, a charging roller 52, a developing apparatus 20, a pre-exposing unit 54, a regulation blade 55, a transfer roller 147, serving as a transfer body, and an image density sensor 172, serving as an image density detection unit. The transfer roller 147 contacts with the photosensitive drum 51 and forms a transfer portion with the photosensitive drum 51, and in a state where transfer bias is applied to the transfer portion, the toner image formed on the photosensitive drum 51 is transferred to the sheet S. The image density sensor 172 is provided to face a portion of the photosensitive drum 51 downstream in a direction of rotation of a developing position, and upstream in the direction of rotation of a transfer portion. The image density sensor 172 detects image density of a patch image for controlling the image density, that is, toner image for controlling image density, formed on the photosensitive drum 51. The control unit 11 can control a developing bias and form a patch image on the photosensitive drum 51.

A charging bias power supply 60, a developing bias power supply 61, a transfer bias power supply 162, a toner density sensor 71 and an image density sensor 172 are connected to the control unit 11. If the target toner density set based on the detected image density reaches a limit value of the predetermined setting range, the control unit 11 sets a transfer condition at a transfer portion based on the detected image density. Even in this case, the control unit 11 sets a correction value of a secondary transfer current based on the detected image density. Therefore, even if the target toner density is maintained at the upper limit value or the lower limit value, the transfer condition can be optimized according to the image density.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138699, filed Jul. 13, 2016, which is hereby incorporated by reference herein in its entirety.

What is claimed is:

1. An image forming apparatus comprising:

an image bearing member configured to bear an electrostatic image;

a developing apparatus configured to develop the electrostatic image formed on the image bearing member with toner using a two-component developer including toner and carrier;

a toner supply portion configured to supply toner to the developing apparatus;

a toner density detection portion configured to detect a toner density corresponding to a percentage of weight of the toner in the developer in an interior of the developing apparatus;

an intermediate transfer body configured to contact with the image bearing member and form a primary transfer portion with the image bearing member, a toner image formed on the image bearing member being primarily transferred to the intermediate transfer body in a state where a primary transfer bias is applied to the primary transfer portion;

a secondary transfer body configured to contact with the intermediate transfer body and form a secondary transfer portion with the intermediate transfer body, a toner image primarily transferred to the intermediate transfer body being secondarily transferred onto a recording material by the secondary transfer body in a state where a secondary transfer bias is applied to the secondary transfer portion;

an image density detection unit configured to detect an image density of a toner image for controlling image density; and a control unit configured to control a supply amount of toner from the toner supply portion to the developing apparatus based on a relationship between the toner density detected by the toner density detection portion and a target toner density, and configured to change the target toner density based on the image density detected by the image density detection unit, the target toner density being limited in a predetermined setting range, wherein in a state where the target toner density reaches a limit value of the predetermined setting range, the limit value being one of a lower limit value and an upper limit value, the control unit is configured to set a transfer condition of at least one of the primary transfer portion and the secondary transfer portion based on the image density detected by the image density detection unit.

2. The image forming apparatus according to claim 1, wherein the transfer condition comprises a transfer current.

3. The image forming apparatus according to claim 2, wherein in a state where the target toner density reaches the lower limit value, the control unit is configured to lower an absolute value of the transfer current, if a difference value obtained by subtracting a predetermined reference image density from the image density detected by the image density detection unit is equal to or greater than a predetermined value.

4. The image forming apparatus according to claim 2, wherein in a state where the target toner density reaches the lower limit value, the control unit is configured to lower an absolute value of the transfer current by a first correction value, if a difference value obtained by subtracting a predetermined reference image density from the image density detected by the image density detection unit is equal to or greater than a predetermined value, and the control unit is configured to lower the absolute value of the transfer current by a second correction value smaller than the first correction value, if the difference value is smaller than the predetermined value.

5. The image forming apparatus according to claim 2, wherein in a state where an accumulated value of an image ratio of recording materials of a predetermined number of sheets to which images are formed is equal to or greater than a predetermined accumulated value, and the target toner density reaches the lower limit value, the control unit is configured to lower an absolute value of the transfer current by a first correction value, if a difference value obtained by subtracting a predetermined reference image density from the image density detected by the image density detection unit is equal to or greater than a predetermined value, and the control unit is configured to lower the absolute value of the transfer current by a second correction value smaller than the first correction value, if the difference value is smaller than the predetermined value, and in a state where the accumulated value is smaller than the predetermined accumulated value, and the target toner density reaches the lower limit value, the control unit is configured to lower the absolute value of the transfer current by a third correction value smaller than the second correction value, if the difference value is equal to or greater than the predetermined value, and the control unit is configured to maintain the transfer current, if the difference value is smaller than the predetermined value.

6. The image forming apparatus according to claim 2, wherein in a state where the target toner density reaches the upper limit value, the control unit is configured to increase an absolute value of the transfer current, if the difference value obtained by subtracting a predetermined reference image density from the image density detected by the image density detection unit is equal to or greater than a predetermined value.

7. The image forming apparatus according to claim 1, wherein the transfer condition comprises a transfer current at the secondary transfer portion.

8. The image forming apparatus according to claim 7, wherein the image density detection unit is arranged to face the intermediate transfer body.

9. The image forming apparatus according to claim 1, wherein the intermediate transfer body is an endless intermediate transfer belt stretched rotatably around a plurality of rollers.

10. An image forming apparatus comprising:

an image bearing member configured to bear an electrostatic image;

a developing apparatus configured to develop the electrostatic image formed on the image bearing member with toner;

a toner supply portion configured to supply toner to the developing apparatus;

a toner density detection portion configured to detect a toner density corresponding to a percentage of weight of the toner in the developer in an interior of the developing apparatus;

a transfer body configured to contact with the image bearing member and form a transfer portion with the image bearing member, a toner image formed on the image bearing member being transferred onto a recording material by the transfer body in a state where a transfer bias is applied to the transfer portion;

an image density detection unit configured to detect an image density of a toner image for controlling image density formed on the image bearing member; and a control unit configured to control a supply amount of toner from the toner supply portion to the developing apparatus based on a relationship between the toner density detected by the toner density detection portion and a target toner density, and configured to change the target toner density based on the image density detected by the image density detection unit, the target toner density being limited in a predetermined setting range, wherein in a state where the target toner density reaches a limit value of the predetermined setting range, the limit value being one of a lower limit value and an upper limit value, the control unit is configured to set a transfer condition of the transfer portion based on the image density detected by the image density detection unit.

* * * * *